US009312090B2

(12) United States Patent
Kaufmann et al.

(10) Patent No.: US 9,312,090 B2
(45) Date of Patent: Apr. 12, 2016

(54) X-RAY EMITTER HOUSING

(71) Applicants: Sebastian Kaufmann, Wendelstein (DE); Andreas Körner, Elsendorf (DE); Petra Maurer, Heroldsbach (DE); Lothar Werner, Weiβenohe/Dorfhaus (DE)

(72) Inventors: Sebastian Kaufmann, Wendelstein (DE); Andreas Körner, Elsendorf (DE); Petra Maurer, Heroldsbach (DE); Lothar Werner, Weiβenohe/Dorfhaus (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/078,102

(22) Filed: Nov. 12, 2013

(65) Prior Publication Data

US 2014/0133634 A1 May 15, 2014

(30) Foreign Application Priority Data

Nov. 13, 2012 (DE) ..... 10 2012 220 636

(51) Int. Cl.
*H01J 35/16* (2006.01)
*H05G 1/04* (2006.01)

(52) U.S. Cl.
CPC . *H01J 35/16* (2013.01); *H05G 1/04* (2013.01)

(58) Field of Classification Search
USPC ..... 378/121, 193, 201, 204
See application file for complete search history.

(56) References Cited

U.S. PATENT DOCUMENTS

| | | | | | |
|---|---|---|---|---|---|
| 3,500,961 | A | * | 3/1970 | Eberhardt et al. | 184/31 |
| 4,335,928 | A | * | 6/1982 | Barrett | A61B 6/00 439/271 |
| 5,199,718 | A | * | 4/1993 | Niemiec | F16J 15/004 277/552 |
| 5,309,497 | A | * | 5/1994 | Goetzl | H01J 35/16 378/193 |
| 5,695,369 | A | | 12/1997 | Swenson, Sr. | |
| 6,213,805 | B1 | | 4/2001 | Jedlitschka et al. | |

FOREIGN PATENT DOCUMENTS

| | | | | |
|---|---|---|---|---|
| CN | 1179021 | A | | 4/1998 |
| CN | 1226800 | A | | 8/1999 |
| CN | 102237242 | A | | 11/2011 |
| CN | 202093189 | U | | 12/2011 |
| CN | 102606782 | A | | 7/2012 |
| DE | 4207174 | | | 9/1993 |
| DE | 102008029355 | | | 12/2009 |
| GB | 2486586 | A | | 6/2012 |
| JP | 2002-260534 | | | 9/2002 |
| JP | 2002260534 | | * | 9/2002 |
| JP | 2002260534 | A | * | 9/2002 |

OTHER PUBLICATIONS

German Office Action cited in German Patent Application No. 10 2012 220 636.1 dated Jun. 4, 2013, with English translation.

Chinese Office action for related Chinese Application No. 201310571431.9, dated Aug. 18, 2015, with English Translation.

* cited by examiner

*Primary Examiner* — Phillip A Johnston
*Assistant Examiner* — Hsien Tsai
(74) *Attorney, Agent, or Firm* — Lempia Summerfield Katz LLC

(57) ABSTRACT

An x-ray emitter housing includes a first housing part and a second housing part that are connected to one another in a form-fit manner using an axially acting threaded ring.

20 Claims, 1 Drawing Sheet

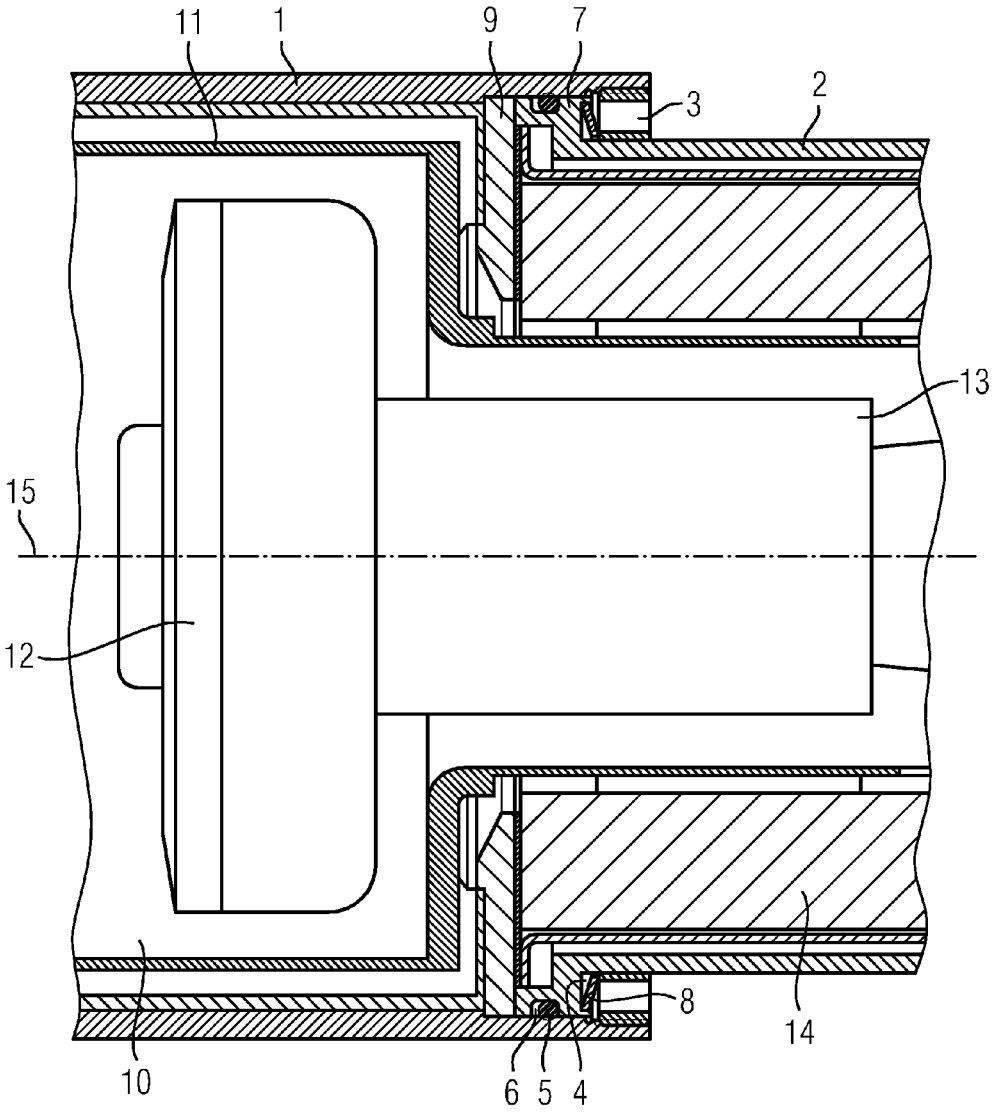
11
1
9
7
3
2
13
15
12
8
14
10
6
5
4

X-RAY EMITTER HOUSING

This application claims the benefit of DE 10 2012 220 636.1, filed on Nov. 13, 2012, which is hereby incorporated by reference in its entirety.

BACKGROUND

The present embodiments relate to an x-ray emitter housing.

An x-ray emitter housing is an integral part of an x-ray emitter. In a fully assembled x-ray emitter, an x-ray tube is fixedly (e.g., fixed anode x-ray tube or rotary anode x-ray tube) or rotatably (e.g., rotary piston x-ray tube) arranged in the x-ray emitter housing.

Electrons are thermally generated in the x-ray tube by an electron source (e.g., coiled filament, flat emitter) and are accelerated toward an anode (e.g., fixed anode or rotary anode). When the electrons strike the anode, effective radiation is generated. Approximately 99% of the kinetic energy of the electrons is converted into heat, and only approximately 1% is converted into effective radiation. The generated effective radiation escapes through a radiation outlet window from the vacuum housing of the x-ray tube and then through a radiation outlet window from the x-ray emitter housing. The heat arising must be effectively discharged during operation of the x-ray tube by a cooling system. A cooling medium (e.g., water, oil) circulates in the x-ray emitter housing. The cooling medium flows around the vacuum housing on an exterior (e.g., the surfaces facing the cooling medium).

The vacuum housing is to be configured for ultra high vacuum, and is therefore welded. The x-ray emitter housing is only to be coolant tight (e.g., oil tight). The components of the emitter housing (e.g., a first housing part and a second housing part) are therefore only screwed to one another. These screwed connections are to exhibit a constantly high tightness even under extreme temperature change loads.

In order to provide the tightness of the x-ray emitter housing, O-rings that are compressed by pressure with the two housing parts to be connected are used. The contact pressure is to be evenly distributed over the entire circumference of the O-ring, so that the connection of the two housing parts connected to one another is constantly tight across the entire surface.

The connection between the first housing part and the second housing part is realized in a known x-ray emitter housing by a plurality of screws arranged and guided radially around the housing. By using a limited number of screws, the contact pressure may only be applied at particular points and is thus not transmitted completely homogeneously onto the O-ring. On account of the radial screw connections, a fixed alignment of the two housing parts with respect to one another is to be provided.

With a longer operating duration and the extreme temperature change loads frequently occurring as a result, with the known x-ray emitter housing, the contact pressure acting on particular points may reduce, thereby impairing the tightness of the x-ray emitter housing.

JP 2002-260534 A describes a rotary anode-x-ray tube. The vacuum housing of the rotary anode-x-ray tube includes a metal housing part and a glass housing part. The rotary anode is arranged in the metal housing part, which has a larger diameter than the glass housing part. A rotor of an electrical drive is arranged within the glass housing part for the rotary anode. A stator of the electrical drive is arranged outside the glass housing part. The two housing parts of the vacuum housing are connected in a vacuum-tight manner to one another by a circumferential sealing ring.

DE 10 2008 029 355 A1 describes an x-ray tube with a vacuum housing, in which a cathode arrangement and an anode arrangement are arranged. The vacuum housing includes a first housing part and a second housing part. The first housing part and the second housing part are each configured as a half shell. The cathode arrangement and the anode arrangement are mounted, for example, in the first housing part and are electrically conductively connected to corresponding high voltage connections. After assembling all the components to be introduced into the vacuum housing, the second housing part is attached to the first housing part, and both housing parts are connected to one another in a vacuum-tight manner by a circumferential weld seam.

DE 42 07 174 A1 discloses an x-ray emitter with an emitter housing. An x-ray tube that includes a vacuum housing is arranged in the emitter housing. The x-ray emitter also includes a fastening apparatus for fastening the x-ray emitter to a support (e.g., the x-ray emitter support of an x-ray diagnostics facility). The fastening apparatus is attached to the vacuum housing of the x-ray tube and guided outwards through the emitter housing.

SUMMARY AND DESCRIPTION

The scope of the present invention is defined solely by the appended claims and is not affected to any degree by the statements within this summary.

The present embodiments may obviate one or more of the drawbacks or limitations in the related art. For example, an x-ray emitter housing that has a constantly high tightness throughout an entire operating duration is provided.

The x-ray emitter housing includes a first housing part and a second housing part (e.g., two housing parts) that are connected to one another in a form-fit manner with an axially acting threaded ring.

With the x-ray emitter housing, as a result of the first housing part and the second housing part being connected to one another in a form-fit manner by an axially acting threaded ring, contact pressure is evenly distributed on a sealing element arranged between the first housing part and the second housing part.

The sealing element arranged between the two housing parts may be embodied, for example, as a radial sealing ring (O-ring) that is placed in a groove prior to assembly of the two housing parts. Alternatively, the sealing element may, for example, also be molded on one of the two housing parts or cast in one of the two housing parts. Other embodiments of a sealing element may also be provided.

With one or more of the present embodiments, the principle of the radial screw of the housing parts is satisfied by the use of an individual, large threaded ring. The threaded ring, which is screwed axially into the x-ray emitter housing and compresses the sealing element via a bevel onto the sealing element, distributes the contact pressure evenly onto the sealing element between the first housing part and the second housing part.

One or more of the present embodiments allows for an x-ray emitter housing to be assembled in a significantly simpler manner and with a considerable time-saving. It is no longer necessary to connect the two housing parts with one another in a form-fit manner using a plurality of individual screws. The threaded ring is screwed axially into the housing. Assembly is also facilitated, in that free accessibility is not required over the entire circumference of the x-ray emitter housing. As a result, assembly and auxiliary apparatuses such as adjustment gages may be constructed in a much simpler manner.

The threaded ring may be screwed into the x-ray emitter housing with the aid of a special tool. As a result, an unauthorized disassembly of the components is advantageously prevented.

A reliable, constant tightness of the connection between the first housing part and the second housing part is provided by the pressure ring. Unlike a radial screw connection between the two housing parts, which results in an uneven and punctiform pressure on the sealing element, the contact pressure is evenly distributed onto the sealing element (e.g., radial sealing ring (O-ring) with the contact pressure).

One or more of the present embodiments are suited to a plurality of differently structured x-ray emitter housings. In one embodiment, the first housing part has a larger diameter than the second housing part. With an x-ray emitter housing embodied in this way, an embodiment, in which the threaded ring has an outer thread, and the first housing part has a corresponding inner thread, is advantageous.

According to a further embodiment, the first housing part and the second housing part are connected in a form-fit manner with one another using at least one form-fit element. Form-fit elements, which are suited hereto, are, for example, feather keys, grooved pins and lugs in or on one of the two housing parts.

In one embodiment, the first housing part is embodied so as to at least partly receive an x-ray tube. Assembly of an x-ray emitter is significantly simplified on account of this measure.

With a rotatable anode (e.g., rotary anode-x-ray tube or rotary piston-x-ray tube), it is advantageous if the second housing part is embodied to at least partly receive a drive motor for an anode. An embodiment, in which a stator of the drive motor is arranged on an interior of the second housing part, is advantageous, for example, for a drive motor embodied as an internal rotor motor.

According to another embodiment, a damping plate is arranged between the first housing part and the second housing part. Possibly occurring oscillations of the drive motor may be fully damped using the damping plate during operation of the x-ray emitter.

An x-ray emitter may be produced with the x-ray emitter housing.

BRIEF DESCRIPTION OF THE DRAWINGS

FIG. 1 shows a part longitudinal section of one embodiment of an x-ray emitter housing.

DETAILED DESCRIPTION

In one embodiment, an x-ray emitter housing includes a first housing part 1 and a second housing part 2 that are connected to one another in a form-fit manner using an axially acting threaded ring 3.

With the embodiment of the x-ray emitter housing shown, the first housing part 1 has a larger diameter than the second housing part 2. This produces a gap 4 between the first housing part 1 and the second housing part 2.

A sealing element 5 is arranged between the first housing part 1 and the second housing part 2. The sealing element 5 is embodied in the exemplary embodiment shown as a radial sealing ring (O-ring). The radial sealing ring 5 is placed into a circumferential annular groove 6 prior to the first housing part 1 and the second housing part 2 being screwed together. The threaded ring 3 is then axially screwed into the x-ray emitter housing. The threaded ring 3 has an outer thread, and the first housing part 1 has a corresponding inner thread.

When the threaded ring 3 is screwed in, the radial sealing ring 5 is compressed onto the sealing material via a bevel, so that the contact pressure is evenly distributed onto the radial sealing ring 5 between the first housing part 1 and the second housing part 2.

The second housing part 2 has ring-shaped projection 7 at an end that faces the first housing part. The circumferential annular groove 6 is arranged in the ring-shaped projection 7. A disk spring 8 is also arranged between the ring-shaped projection 7 and the threaded ring 3. The disk spring 8 maintains the pre-stressing force and prevents settling effects.

A damping plate 9 is arranged between the first housing part 1 and the second housing part 2 in the x-ray emitter housing shown, by which the oscillations of the drive motor occurring during the drive of the rotary anode 12 are completely damped and may not be transmitted onto the vacuum housing 11 of the x-ray tube 10.

In the embodiment of the x-ray emitter housing shown, the first housing part 1 receives an x-ray tube 10. The x-ray tube 10 includes a vacuum housing 11, in which a rotary anode 12 is arranged. The rotary anode 12 sits on a rotor shaft 13 that is moved by an electrical drive motor in a rotational movement about an axle 15. For the sake of clarity, only the stator 14 of the drive motor is shown. The stator 14 is arranged on an interior in the second housing part 2 in the exemplary embodiment shown in the figure.

Although the invention is illustrated and described in more detail by the exemplary embodiment, the invention is not restricted by the exemplary embodiment shown in the drawing. Instead, other variants of the inventive may also be derived herefrom by the person skilled in the art, without departing from the underlying inventive idea.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An x-ray emitter housing comprising:

a first housing part;

a second housing part;

a radially sealing element;

an axially acting threaded ring; and a disk spring;

wherein the first housing part has a larger diameter than the second housing part, and wherein at least a portion of the first housing part overlaps the second housing part along a radial axis of the x-ray emitter housing, wherein the first housing part and the second housing part are connected to one another in a form-fit manner with the axially acting threaded ring, wherein the axially acting threaded ring is positioned between the portion of the first housing part that overlaps the second housing part, wherein the second housing part comprises a ring-shaped projection having a circumferential annular groove, the ring-shaped projection located at an end of the second housing part facing outward from a center of the x-ray emitter housing toward the first housing part, wherein the radially sealing element is arranged within the circumferential annular groove of the ring-shaped projection, and wherein the disk spring is arranged between the axially acting threaded ring and the ring-shaped projection, the disk spring configured to maintain pre-stressing forces and prevent settling effects.

2. The x-ray emitter housing of claim 1, wherein the threaded ring has an outer thread, and the first housing part has a corresponding inner thread.

3. The x-ray emitter housing of claim 1, wherein the first housing part and the second housing part are connected to one another in the form-fit manner with at least one form-fit element.

4. The x-ray emitter housing of claim 1, wherein the first housing part is configured to at least partly receive an x-ray tube.

5. The x-ray emitter housing of claim 1, wherein the second housing part is configured to at least partly receive a drive motor for a rotary anode.

6. The x-ray emitter housing of claim 5, wherein a stator of the drive motor is arranged on an interior of the second housing part.

7. The x-ray emitter housing of claim 1, wherein a damping plate is arranged between the first housing part and the second housing part.

8. The x-ray emitter housing of claim 2, wherein the first housing part and the second housing part are connected to one another in a form-fit manner with at least one form-fit element.

9. The x-ray emitter housing of claim 2, wherein the first housing part is configured to at least partly receive an x-ray tube.

10. The x-ray emitter housing of claim 2, wherein the second housing part is configured to at least partly receive a drive motor for a rotary anode.

11. The x-ray emitter housing of claim 10, wherein a stator of the drive motor is arranged on an interior of the second housing part.

12. An x-ray emitter comprising:

an x-ray tube; and an x-ray emitter housing comprising:

a first housing part;

a second housing part;

a radially sealing element;

an axially acting threaded ring; and a disk spring;

wherein the first housing part has a larger diameter than the second housing part, and wherein at least a portion of the first housing part overlaps the second housing part along a radial axis of the x-ray emitter housing, wherein the first housing part and the second housing part are connected to one another in a form-fit manner with the axially acting threaded ring, wherein the axially acting threaded ring is positioned between the portion of the first housing part that overlaps the second housing part, wherein the second housing part comprises a ring-shaped projection having a circumferential annular groove, the ring-shaped projection located at an end of the second housing part facing outward from a center of the x-ray emitter housing toward the first housing part, wherein the radially sealing element is arranged within the circumferential annular groove of the ring-shaped projection, wherein the disk spring is arranged between the axially acting threaded ring and the ring-shaped projection, the disk spring configured to maintain pre-stressing forces and prevent settling effects, and wherein the x-ray tube is arranged in the x-ray emitter housing.

13. The x-ray emitter of claim 12, wherein the threaded ring has an outer thread, and the first housing part has a corresponding inner thread.

14. The x-ray emitter of claim 12, wherein the first housing part and the second housing part are connected to one another in the form-fit manner with at least one form-fit element.

15. The x-ray emitter of claim 12, wherein the first housing part is configured to at least partly receive the x-ray tube.

16. The x-ray emitter of claim 12, wherein the second housing part is configured to at least partly receive a drive motor for a rotary anode.

17. The x-ray emitter of claim 16, wherein a stator of the drive motor is arranged on an interior of the second housing part.

18. The x-ray emitter of claim 12, wherein a damping plate is arranged between the first housing part and the second housing part.

19. The x-ray emitter housing of claim 3, wherein the form-fit element is a feather key, grooved pin, or lug positioned in or on the first housing part or the second housing part.

20. The x-ray emitter housing of claim 1, wherein the radial sealing element is an O-ring, and wherein the O-ring is configured to be compressed via a bevel, such that contact pressure is evenly distributed onto the O-ring between the first housing part and the second housing part.

* * * * *